United States Patent [19]

Ruegg

[11] Patent Number: 4,588,101

[45] Date of Patent: May 13, 1986

[54] SAFETY VENT FOR CONTAINERS

[75] Inventor: Josef N. Ruegg, Tallapoosa, Ga.

[73] Assignee: Southern Can Company, Tallapoosa, Ga.

[21] Appl. No.: 659,544

[22] Filed: Oct. 10, 1984

[51] Int. Cl.[4] ..... B65D 51/16; B65D 83/14; F16K 17/14

[52] U.S. Cl. ..... 220/89 A; 137/68.1; 222/397

[58] Field of Search ..... 220/89 A; 137/68 R, 137/68.1; 222/397

[56] References Cited

U.S. PATENT DOCUMENTS

| | | | |
|---|---|---|---|
| 3,070,265 | 12/1962 | Everett . | |
| 3,245,578 | 4/1966 | Sutton . | |
| 3,405,838 | 9/1968 | Preisendanz . | |
| 3,724,727 | 4/1973 | Zundel . | |
| 3,815,534 | 6/1974 | Kneusel . | |
| 3,826,412 | 7/1974 | Kneusel . | |
| 3,831,822 | 8/1974 | Zundel . | |
| 3,921,556 | 11/1975 | Wood et al. . | |
| 3,979,009 | 9/1976 | Walker | 220/66 |
| 4,003,505 | 1/1977 | Hardt . | |
| 4,416,388 | 11/1983 | Mulawski . | |
| 4,513,874 | 4/1985 | Mulawski | 220/89 A |

FOREIGN PATENT DOCUMENTS

| | | |
|---|---|---|
| 545814 | 3/1977 | U.S.S.R. . |
| 549636 | 3/1977 | U.S.S.R. . |

*Primary Examiner*—Allan N. Shoap

*Attorney, Agent, or Firm*—Antonelli, Terry & Wands

[57] ABSTRACT

A safety vent for an internally pressurized fluid container is disclosed. The safety vent is provided in a wall of the container which is subject to outward deformation when the internal pressure of the container exceeds a predetermined level. The wall has a weakened line of reduced material thickness formed therein which is adapted to fracture to vent the pressurized fluid from the container in response to the stresses therein during the outward deformation of the wall. The wall further includes an elongated rib formed therein with at least one end of the line proximate the weakened line of reduced material thickness. The rib locally weakens the resistance of the wall to outward deformation so that outward deformation of the wall is initiated adjacent the location of the rib. The direction in which deformation progresses and the pressure level at which deformation begins are also controlled by the direction and dimensions of the rib whereby the pressure range for release is less dependent on the residual thickness of the material at the weakened line.

20 Claims, 10 Drawing Figures

SAFETY VENT FOR CONTAINERS

BACKGROUND AND SUMMARY OF THE INVENTION

This invention relates to a safety vent for an internally pressurized fluid container and to a container incorporating the safety vent.

Pressurized fluid containers are well known and widely used for packaging and dispensing a variety of fluid products, including liquids, gases and combinations thereof. These containers perform entirely satisfactorily under normal operating conditions. However, when the contents of such a container become over pressurized by subjecting the container to excessive temperatures, because of improper use or for any other reason, the can will explode and portions of the can may be propelled at dangerously high velocities. Such conditions may occur when the can is accidently subjected to high temperatures during improper use or storage or when the can is incinerated, for example. In order to provide for the safe release of a pressure build-up within the can, a safety vent for the high pressure must be provided. To this end, numerous pressure release devices have been proposed in the art for internally pressurized fluid containers. However, for a variety of reasons including unreliability, high costs, difficulty of maintaining critical tolerances during manufacture, etc., none of these devices have been wholly satisfactory.

One type of known pressure release device for an internally pressurized fluid container is illustrated in FIG. 1 of the drawings. The internally pressurized fluid container 1 shown there is formed with a tubular side wall 2 and upper and lower end walls 3 and 4 which are connected to the tubular side wall. A nozzle or valve 5 is provided in the upper end wall for dispensing the pressurized fluid from the container. The lower end wall or bottom 4 of the container is a dome-shaped inwardly concave end wall which is formed with a single weakened line 6 of reduced material thickness in the form of a score line shaped as an arc of a circle. The end wall has a structural integrity which reacts to an increase in fluid pressure above a prescribed level by initially undergoing at least a partial eversion at a random location along the annular outer area thereof. This eversion or deformation commences then progresses inwardly to stress the weakened line of reduced material thickness and fracture the same whereby the high pressure fluid can be vented from the container.

The aforementioned type of safety vent or pressure release device can be problematical because of the relatively deep scoring which may be required to ensure that venting will occur when the internal pressure of the container exceeds a predetermined level. That is, since the eversion or deformation starts at a random location around the outer periphery of the bottom, the orientation of the weakened line with respect to advancing deformation or eversion is unpredictable. Because the stress experienced at the weakened line during eversion can vary as a function of this orientation, the residual thickness of the material of the end wall at the weakened line must be sufficiently thin to be fractured at the lowest possible stress. The requirement for deep scoring creates manufacturing problems. For example, with a residual material thickness at the weakened line of only 0.0005 to 0.001 inch, there will be a higher number of rejects during manufacturing and a higher number of defective containers referred to as shelf leakers which permit the pressurized fluid to escape from the container, as compared with the numbers of rejects and shelf leakers which occur in scoring material while leaving a greater residual material thickness. Small residual thicknesses at a weakened or scored line can also be problematical in that when the pressurized container is dropped from a shelf, for example, the impact of the container on the floor can fracture the end wall at the weakened line and release the pressurized fluid. If this release is too fast, the container can be propelled in the manner of a rocket and pose a safety hazard to surrounding persons.

Thus, an object of the present invention is to provide an improved safety vent for an internally pressurized fluid container which avoids the aforementioned disadvantages of the known safety vents or pressure release devices. More particularly, an object of the invention is to provide an improved safety vent for an internally pressurized fluid container comprising a wall of the container which is subject to outward deformation when the internal pressure of the container exceeds a predetermined level, with the wall having a weakened line of reduced material thickness formed therein which is adapted to fracture to vent the pressurized fluid from the container in response to the stresses thereon during the outward deformation of the wall, wherein the residual material thickness of the wall at the weakened line need not be extremely small to ensure fracture thereof and venting when the internal pressure exceeds a predetermined level. Thus, manufacturing problems resulting in a high number of rejects or shelf leakers can be avoided.

A further object of the invention is to provide a safety vent for an internally pressurized fluid container of the aforementioned type which has a sufficiently thick residual material thickness at the weakened line that the container can be accidentally dropped without risking fracture of the weakened line of reduced material thickness simply from the impact of the container striking the floor or other surface.

Another object of the invention is to provide an improved safety vent for an internally pressurized container which controls the direction of pressure release to the side of the container to prevent the container from being propelled in the manner of a rocket regardless of the rate of pressure release thereby reducing the safety hazard to surrounding persons.

An additional object is to provide an improved safety vent which opens almost immediately with the initiation of deformation of the container wall and wherein the degree of opening is controlled for safe venting under a wide variety of conditions.

Still another object of the invention is to provide an improved safety vent with a performance which does not depend on the cross-sectional area of the scored area in the container wall but on the whole wall.

These and other objects of the invention are attained by the safety vent for an internally pressurized fluid container of the invention which comprises a wall of the container which is subject to outward deformation when the internal pressure of the container exceeds a predetermined level, a weakened line of reduced material thickness formed in the wall and adapted to fracture to vent the pressurized fluid from the container in response to the stresses during the outward deformation of the wall, and means for controlling the location in the wall at which the deformation starts when the internal pressure of the container exceeds the predetermined level. It has been found that by controlling the location of the initiation of deformation, the orientation of the advancing deformation with respect to the weakened line can be optimized to uniformly create relatively high stress for fracturing the weakened line when internal pressures in the container exceed a predetermined level. Thus, an extremely thin residual material thickness at the weakened line is not required for reliable opening of the safety vent and the operation of the vent is made less dependent upon this thickness.

According to the disclosed form of the invention, the means for controlling the location in the wall at which the deformation starts includes means for locally weakening the resistance of the wall to outward deformation from the internal pressure of the container. The location of the weakened area or areas determines where deformation will be started when the internal pressure of the container exceeds the predetermined level. The degree of weakening can be selected to control the internal pressure at which deformation will start. In this form of the invention the means for controlling the location in the wall at which the deformation starts also controls the direction in which the outward deformation progresses so that its progress is in a direction toward the weakened line of reduced material.

In the preferred form of the invention the container wall containing the safety vent is an end wall which is joined to or formed integrally with one end of a tubular side wall of the container. The weakened line of reduced material thickness is preferably located in a central portion of the end wall. The means for controlling the location in the end wall at which the deformation starts is located radially outwardly from the weakened line and is in the form of an elongated rib formed in the wall and extending in a radial direction in the end wall between the outer rim of the end wall and the weakened line. The rib locally weakens the resistance of the end wall to outward deformation so that deformation is initiated along the outer rim of the end wall at a point spaced radially outwardly from the end of the elongated rib. The deformation progresses radially inwardly from the end of the elongated rib. The rib itself is very strong and resists deformation so that it acts as a lever to transfer stress from its one end adjacent the deformation to its other end adjacent the weakened line. If a small amount of deformation occurs it will result in a small opening or tear at the weakened line for venting while a larger deformation associated with a larger pressure build-up will result in a larger opening or tear. In this way the degree of opening is controlled for safe venting under a wide variety of conditions. The manner of opening of the vent is also such as to result in venting of the pressurized fluid toward the side of the container to preclude rocket-like action. The weakened line of reduced material thickness is located so as to extend transverse to the direction of progressive deformation to facilitate fracturing at the weakened line and venting of the container. In the disclosed form of the invention the weakened line of reduced material thicknesas is in the form of an arc of a circle located in the end wall.

While a single elongated rib and weakened line can be used in a safety vent according to the invention, in the disclosed preferred embodiment of the invention a pair of weakened lines of reduced material thickness in the form of arcs are located in spaced relationship on opposite sides of a circle about the center of the end wall and a pair of elongated ribs are formed in the end wall radially outwardly from central portions of respective ones of the weakened lines with the elongated ribs extending in radial directions in the end wall. The internal pressure of the container at which deformation of the end wall and venting occur can be controlled according to the invention by selection of the rib length, depth and location so that the venting pressure is less dependent on the residual material thickness at the weakened line. As a result, according to the invention, the residual material thickness at the weakened line need not be extremely small or have high tolerances but can be between 0.002 and 0.005 inch, for example. This reduces the manufacturing problems which can occur where residual thickness of only 0.0005 to 0.001 inch are required. The use of higher residual thicknesses at the weakened line also eliminates the problems associated with accidental opening when an internally pressurized fluid container is dropped or otherwise impacted.

These and other objects, features and advantages of the invention will become more apparent from the following description when taken in connection with the accompanying drawings which show, for purpose of illustration only, one preferred embodiment in accordance with the invention.

DESCRIPTION OF THE DISCLOSED EMBODIMENT

Figure 2:
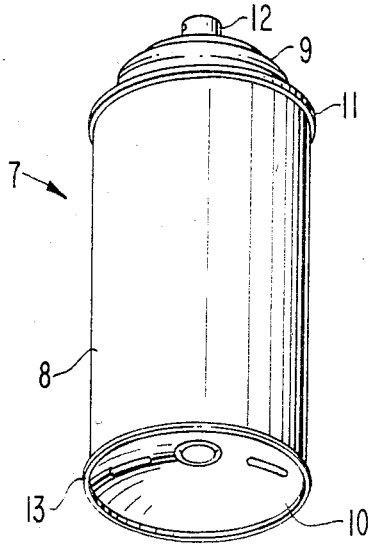
FIG. 2 is a perspective view from the side and slightly below of an internally pressurized fluid container having a safety vent according to the present invention.

Referring now to the drawings, and particularly FIG. 2 thereof, there is illustrated a container 7 of the invention for a pressurized fluid. The container is a metal can comprising a tubular side wall and upper and lower end walls 9 and 10. The container 7 could also be formed from materials other than metal such as plastic. The upper end wall 9 is joined in a conventional manner to the tubular side wall 8 at seam 11 as shown but, alternatively it could be formed integrally with the side wall 8. A nozzle or valve 12 is provided in the end wall 9 for dispensing a fluid such as Freon stored under pressure in the container 7. Bottom wall 10 is a dome-shaped inwardly concave wall which is joined to the lower end of the tubular side wall 8 by any conventinal means such as a double seam connection shown at 13 in the drawing. Alternatively, the dome-shaped end could be formed integrally with the tubular side wall.

Figure 3:
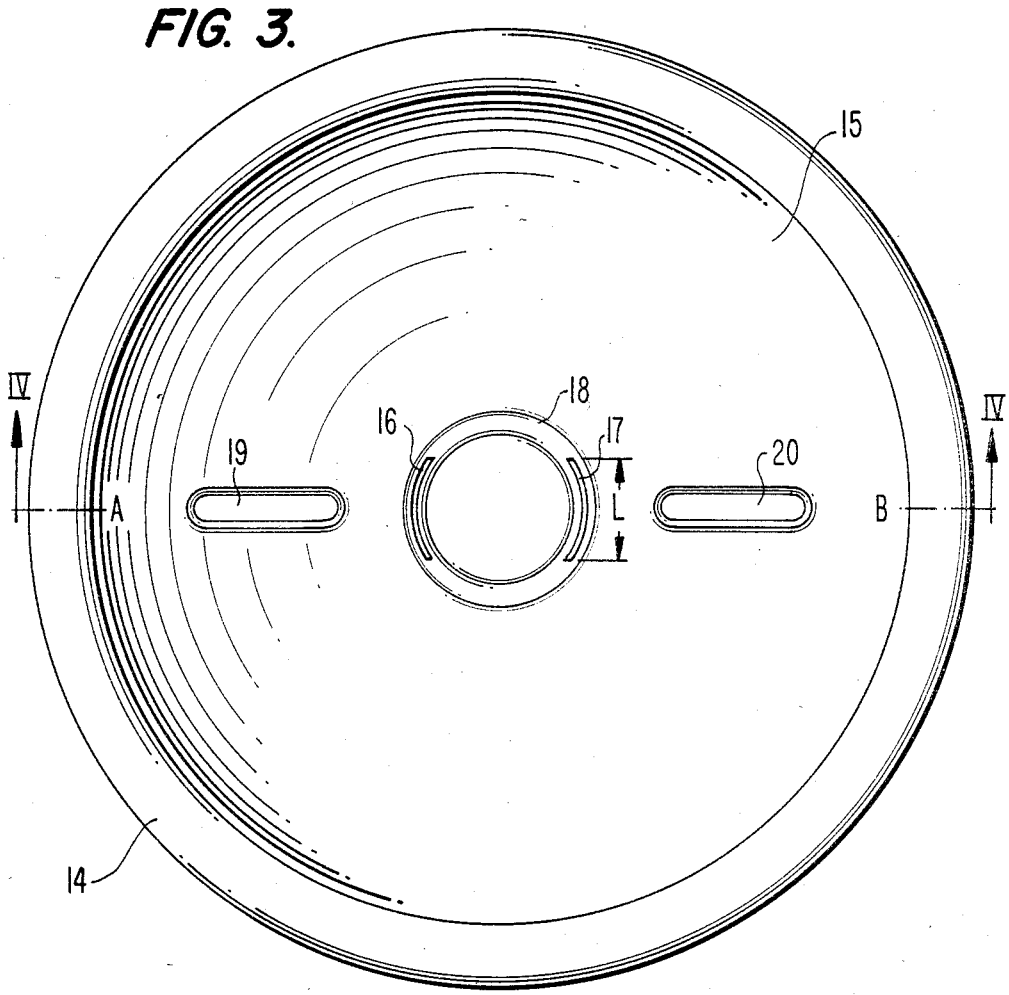
FIG. 3 is a plan view of the exterior side of the bottom wall of the container of FIG. 2 showing the safety vent of the invention in greater detail.
Figure 4:
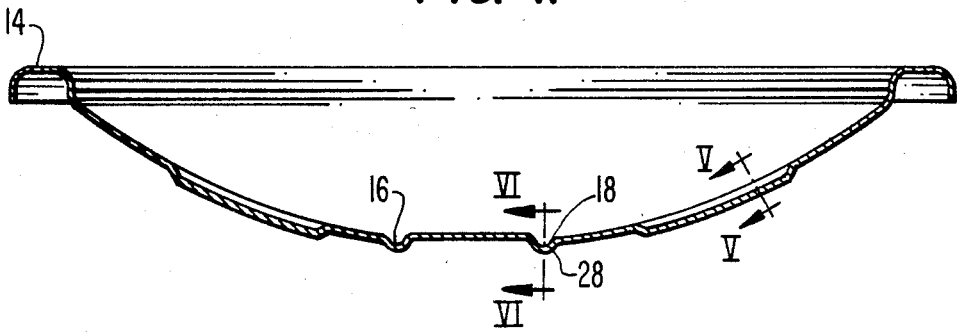
FIG. 4 is a cross-sectional view of the container wall of FIG. 3 taken along the line IV—IV.

FIGS. 3 and 4 of the drawings illustrate the bottom wall 10 in greater detail and as it appears before being seamed onto the lower end of the side wall 8. The circular wall 10 is formed by deep drawing a tempered steel sheet material; such as a 135 pound, tin plated steel sheet material having a thickness of 0.0148 inch and a temper of T5. Other materials and thicknesses could of course be used as will be readily understood by the skilled artisan. The flanged portion 14 shown in the drawings at the outer periphery of the wall 10 is provided for forming the seam 13 with the lower end of the tubular side wall 8. The dome-shaped inwardly concave portion 15 of the wall 10 radially inwardly of the flange portion 14 has a generally uniform radius of curvature of 2.121 inches, for example, for the 211 bottom shown therein. The surfaces of dome portion 15 are relatively smooth and uniform except for the presence of a pair of weakened lines of reduced material thickness 16 and 17, annular recess 18 and elongated ribs 19 and 20. The weakened lines 16 and 17 are in the form of arcs located in spaced relationship on opposite sides in the bottom of the annular recess 18 which is formed about the center of the wall 10. The pair of elongated ribs 19 and 20 are formed in the end wall radially outwardly from central portions of respective ones of the weakened lines 16 and 17. The ribs extend in radial directions in the wall 10 along a line which is transverse, actually perpendicular, to the respective weakened lines 16 and 17.

Figure 1:
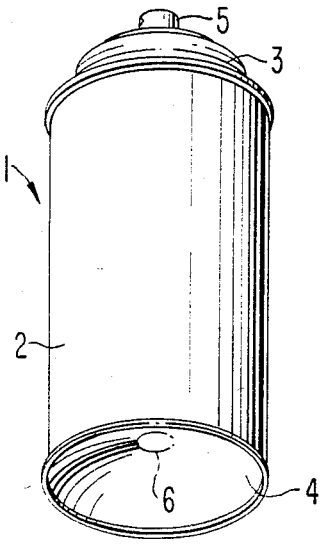
FIG. 1. (PRIOR ART)
FIG. 1 is a perspective view from the side and slightly below of an internally pressurized fluid container with a safety vent according to the prior art.

The dome-shaped, concave portion 15 of the wall 10 has a structural integrity which reacts to an increase of fluid pressure in the container 7 above a prescribed level by initially undergoing at least a partial eversion at a radially outer portion adjacent flange portion 14 or side wall 8 of the container. This outward deformation or eversion progresses inwardly toward the center of the end wall 10. As discussed above, with prior art containers of the type shown in FIG. 1, the initial eversion can occur randomly at any circumferential location adjacent the container side wall. However, by providing an elongated rib or ribs according to the invention, such as the elongated ribs 19 and 20 in the end wall 10 the resistance of the concave end wall to outward deformation is locally weakened in the vicinity of the rib or ribs to control the location at which the end wall 10 is initially outwardly deformed. In the end wall 10, deformation is initiated adjacent the flange portion 14 at a location directly radially outwardly from the end of one of the elongated ribs when the internal pressure of the container exceeds a predetermined level, typically 200–230 psi. That is, the presence of at least one elongated rib controls the location in the wall at which the deformation starts when the internal pressure of the container exceeds a predetermined level. The elongated rib or ribs of the invention also control the direction in which the outward deformation progresses. More specifically, each rib 19 and 20 extends in a radial direction in the end wall 10 so that outward deformation, which is initiated at one of points A and B in FIG. 3 opposite the outer ends of the respective ribs 19 and 20, progresses inwardly from the point along the direction of the adjacent rib toward the center of the end wall.

Figure 7:
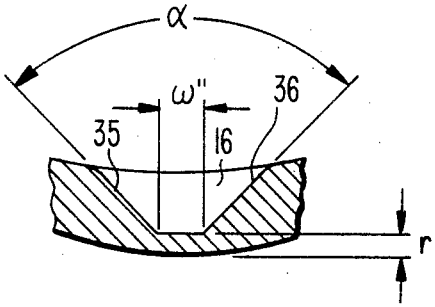
FIG. 7 is an enlarged view in cross-section of the weakened line of reduced material thickness as shown in FIG. 4, the weakened line being located in the bottom and along a portion of the annular recess formed about the center of the container wall.

When the progressive deformation reaches the outer end of the adjacent rib, the rib acts as a lever causing deformation and stress at its inner end which fractures and opens the wall at the weakened line for venting the pressurized fluid. The weakened line adjacent the radially inner end of the rib extends transverse to the direction of the rib and therefore transverse to the direction of deformation progression. This sets up a relatively high concentration of bending stresses along the weakened line for initiating local fracture at the weakened line for venting purposes. It has been found that by controlling in this manner the location in the wall at which deformation starts and the direction in which the outward deformation progresses, the residual thickness of material at the weakened line need not be extremely small or formed of very close tolerances. For example, a residual material thickness r as shown in FIG. 7 of between 0.002 and 0.005 inch can be employed with consistent, reliable fracturing occuring at the weakened line at pressures above a predetermined level.

The elongated ribs 19 and 20 not only provide a means for controlling the location in the wall at which the outward deformation starts when the internal pressure of the container exceeds a predetermined level, but also provide a means for controlling when, that is, at what pressure, outward deformation of the wall and fracturing at the weakened line for venting will occur. In particular, it has been found that the pressure range for release or venting can be controlled by changing the length, depth and location of the elongated ribs. The shorter the ribs, the stronger the resistance of the end wall to outward deformation and, hence, the higher the internal pressure required for venting. The closer the ribs are to the flange portion 14 or side wall 8 in the container, the more it will weaken the bottom or end wall's resistance to outward deformation so that outward deformation, fracturing at the weakened line and venting of the container will occur at a lower internal pressure. Thus, the elongated ribs of the invention provide the two-fold advantage of permitting a degree of control of the pressure level for venting by selection of the rib length, depth and location, and at the same time facilitating fracturing at the weakened lines by controlling the location of deformation initiation and its direction of progression to reduce the dependency of fracturing on the residual material thickness at the weakened lines. The manner of opening the vent also ensures that pressurized fluid is released toward the side of container to prevent rocket propulsion.

Figure 5:
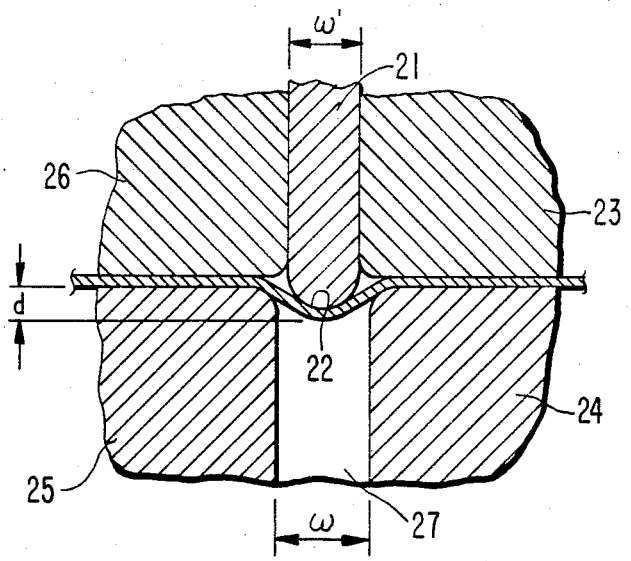
FIG. 5 is a cross-sectional view of an elongated rib in the container wall of FIG. 4 taken along the line V—V and also schematically illustrating the manner of forming the elongated rib.

The elongated ribs 19 and 20 are each press-formed in the dome-shaped inwardly concave end wall 10 by means of a tool 21 having a rounded edge 22 as shown in FIG. 5. The radius of curvature of the edge 22 is 0.047 inch, for example. The dome-shaped end wall 10 is clamped in position during the press forming operation by clamping members 23–26 as the working tool 21 is advanced into a recess 27 defined between clamping members 24 and 25. The recess 27 has a width w of 0.125 inch that determines the width of the elongated ribs 19 and 20. The tool is advanced so as to deform the end wall 10 inwardly a depth d, which is 0.031 inch in the illustrated embodiment. This corresponds to the depth of the elongated ribs below the exterior surface of the end wall 10. Each of the ribs 10 and 20 has a length in the radial direction of the container 7 of 0.500 inch in the illustrated embodiment. However, this dimension as well as the depth and width of the rib can be varied to control the pressure range for release or venting of the container pressure as discussed more fully hereinafter. Moreover, the aforementioned dimensions with respect to the bottom wall 10 of the container 7 are merely exemplary of the 211 bottom incorporating a safety vent according to the invention. Other types of bottoms as well as dimensional variations from those indicated above could be employed without departing from the spirit of the invention as will be readily apparent to the skilled artisan.

Figure 6:
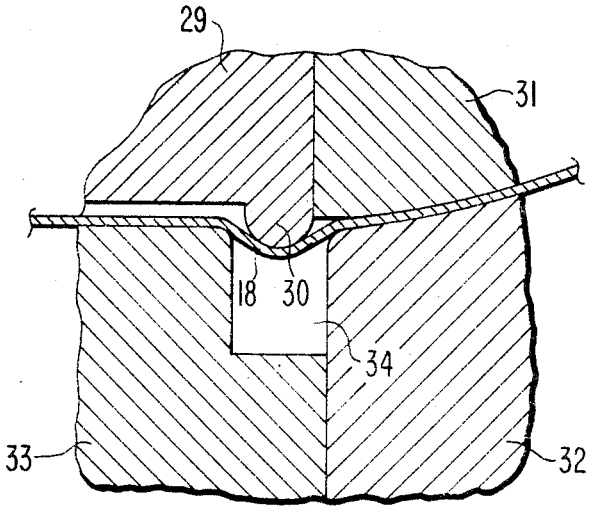
FIG. 6 is a cross-sectional view taken along the line VI—VI of FIG. 4 and illustrating a portion of the annular recess formed in the center of the container wall and the manner of forming the same recess, the weakened line in the recess not being shown.

The weakened lines of reduced material thicknesses 16 and 17 are scored lines in the form of arcs located in spaced relationship on opposite sides of a circle about the center of the end wall 10. The weakened lines are located in the bottom of the annular recesses 19 of the end wall as noted above. The recess and the apparatus for forming the recess are illustrated in FIG. 6. As shown therein, working tool 29 is provided with a rounded tip 30 having a radius of curvature of 0.047 inch. The tool 29 is moved with respect to wall 10 to press form the annular recess 18 therein while the wall is clamped by means of clamping members 30–33. Relative movement between the working tool 29 and the clamped end wall 10 causes the annular rounded tip 30 to deform a portion of the dome-shaped wall 10 into the recess 34 defined between the clamping members 32 and 33. The depth of the recess is 0.015 inch. The width of the recess 34 and hence the width of the annular recess 18, is 0.125 inch. After the annular recess 18 has been formed, the weakened lines of reduced material thickness 16 and 17 are formed by scoring the bottom of the recess 18 on opposite sides of the annular recess as shown in FIG. 7. The score line 16 in FIG. 7 has side walls 35 and 36 which are inclined at an angle of 90 degree with respect to one another. The flat portion at the bottom of the score line has a width w″ of 0.003–0.005 inch. The thickness r of the residual materal of the wall along the weakened line 16 is 0.002 to 0.005 inch. This relatively wide variation in the thickness of the residual material is acceptable for consistent and reliable venting of internal pressures of the container because the elongated ribs of the invention control the location and direction of the progressive eversion of the wall 10 and thereby control the stress for fracturing at the lines 16 and 17. The annular recess 18 in which the weakened lines 16 and 17 are located has a diameter of 0.50 inch in the illustrated embodiment. The length L of the weakened lines 16 and 17 in the radial direction of the end wall 10 as shown in FIG. 3 is preferably 5/16 inch. That is, the arc of each weakened line subtends an angle of less than 90 degrees about the circle at the center of the wall which encompasses the weakened lines and the recess 18. It has been found that if the length L of the weakened lines is significantly increased beyond this length, when fractured, the vent will release at too fast a rate. If length L is significantly smaller than that illustrated, the weakened lines will be too resistant to fracture for venting in the case of a rapid build-up of pressure in the container. This is to be avoided because it can result in a bomb-like explosion of the container.

Test has been conduted with containers having the improved safety vent of the invention by placing a pressurized fluid within the containers and thereafter increasing the pressure of the fluid. Both destructive and non-destructive tests have been used. One destructive test involved connecting a pressure gauge to the containers to monitor the pressure therein while heating the containers with a heating element placed about the side wall of the containers. The containers were heated until a pressure release occurred, either by proper venting at a fractured weakened line as discussed above or otherwise. The results of the tests showed that containers having the improved safety vent of the invention were consistently vented in a safe manner by fractures which occurred at one or both of the weakened lines at pressures in the range of 200 to 230 psi, and typically at pressures between 210 to 220 psi.

Internally pressurized fluid containers having the safety vent of the invention also have been found to consistently pass a Department of Transportation's test for this type of container. The test is a non-destructive test which requires the immersion of the pressurized container in water maintained at 130° F. This temperature increases the pressure in the containers up to about 180 psi. This pressure corresponds to the pressure applied to the fluid contents of a container after filling the container to test the container for score leaks. Drop tests were also performed with pressurized containers of the invention. The results of the tests showed that mere impact of the containers on a hard surface such as a concrete floor does not result in fracturing of the weakened line and venting of the container. Another test involved placing pressurized containers having the safety vent according to the invention in hot water above 170° F. to rapidly increase the pressure in the containers to a level above 230 psi. In these tests the safety vents functioned to vent the pressurized fluid in a safe manner. In summary the various test results showed that the safety vent of the invention safely and reliably releases the pressurized fluid from containers when the pressure thereof exceeds a predetermined level or range.

Figure 8A:
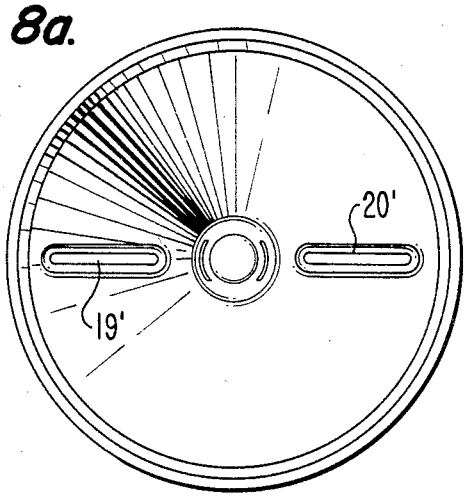
FIG. 8*a* is a plan view of the exterior side of a can bottom with a safety vent according to the invention wherein the length of the elongated ribs is relatively long to attain a weaker bottom wall and hence a lower venting pressure.
Figure 8B:
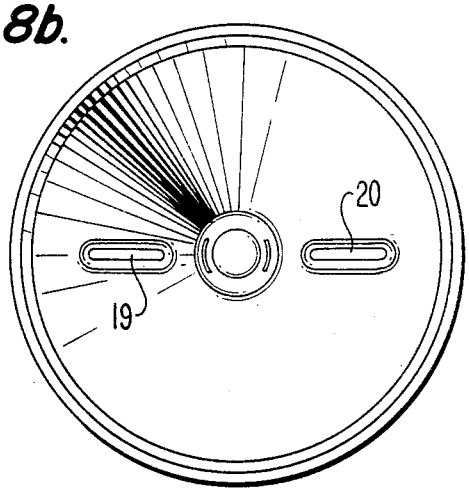
FIG. 8*b* is a plan view of the exterior side of a can bottom according to the invention wherein the length of the elongated ribs is the same as that shown in FIG. 3 and less than that of FIG. 8*a*.
Figure 8C:
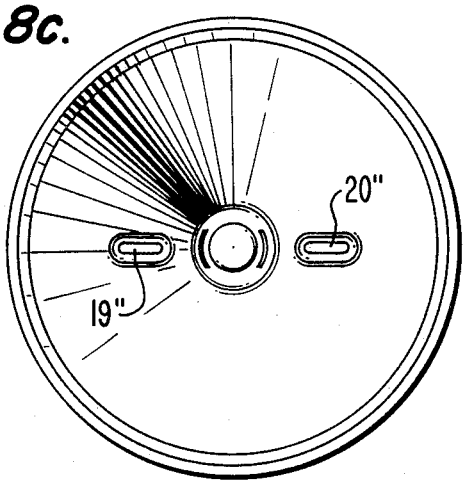
FIG. 8*c* is a plan view of the exterior side of a can bottom according to the invention wherein the length of the elongated ribs of the safety vent is relatively short as compared with that in FIGS. 8*a* and 8*b*.

Deep scoring leaving only a very small residual thickness of material at the weakened line is not required in the safety vent of the invention. The use of an elongated rib according to the invention provides a means for controlling the location in the wall at which the deformation starts when the internal pressure of the container exceeds the predetermined level. The direction in which the deformation progresses is also controlled by the direction of the elongated rib. By selecting the length of the elongated ribs as discussed with reference to FIGS. 8*a* through 8*c*, the pressure level for release can also be controlled. That is, with relatively long ribs such as those shown in FIG. 8*a*, there is a relatively low release pressure because of the weakening of the container wall resistance to outward deformation. On the other hand, relatively short ribs as shown in FIG. 8*c* result in a higher release pressure.

While I have shown and described only one embodiment in accordance with the present invention, it is understood that same is not limited thereto, but is susceptible to numerous changes and modifications as known to those skilled in the art. For example, the safety vent of the invention can employ only a single elongated rib such as rib 19 in FIG. 3 in combination with a single weakened line of reduced material thickness as score line 16 in FIG. 3. However, the use of the pair of ribs and pair of score lines as shown in the disclosed embodiment is preferred as being safer. Further, the weakened line or lines of the wall need not be formed in a recess as shown but could be formed in the unaltered wall. The weakened lines also need not be in the form of an arc of a circle or located centrally in the wall of the container. Instead, a straight weakened line could be employed. The ribs also need not be perpendicular to or even intersect with the weakened lines but could be tangent or parallel thereto so long as at least a portion of the ribs are proximate the weakened line. Further, the ribs could be formed by a technique other than press forming. For example, an elongated thinned or thickened or even locally hardened material could be employed so long as there is a disruption of the balanced uniform deformation of the wall. The safety vent of the invention could also be used on walls of the container other than the bottom wall, such as on the side wall of the container. Therefore, I do not wish to be limited to the details shown and described herein, but intend to cover all such changes and modifications as are encompassed by the scope of the appended claims.

I claim:

1. A safety vent for an internally pressurized fluid container comprising a generally inwardly concave end wall of said container, said end wall having a structural integrity which reacts to an increase in fluid pressure in said container above a predetemined level by initially undergoing at least a partial outward deformation at a location along the outer peripheral area thereof, the outward deformation commencing in said outer peripheral area and progressing inwardly, a weakened line of reduced material thickness formed in said end wall in a location spaced inwardly of said outer peripheral area of said end wall, said weakened line of reduced material thickness being adapted to fracture to vent the pressurized fluid from said container in response to the stresses thereon during said outward deformation of said wall, and means for controlling the location along the outer peripheral area of said end wall at which said deformation starts when the internal pressure of said container exceeds said predetermined level, said means for controlling being located in said end wall between said weakened line of reduced material thickness and said outer peripheral area such that said means for controlling is intersected by a radius line of said end wall which passes through said weakened line of reduced material thickness.

2. A safety vent for an internally pressurized fluid container according to claim 1, wherein said means for controlling the location along the outer peripheral area of said end wall at which said deformation starts includes means for locally weakening the resistance of said end wall to outward deformation at a location in said end wall between said weakened line and the outer area of said end wall.

3. A safety vent for an internally pressurized fluid container according to claim 1, wherein said means for controlling the location in said wall at which said deformation starts also controls the direction in which said outward deformation progresses so that said deformation progresses in a direction toward said weakened line of reduced material.

4. A safety vent for an internally pressurized fluid container according to claim 1, wherein said container wall is an annular end wall which is joined to one end of a tubular side wall of said container.

5. A safety vent for an internally pressurized fluid container comprising a wall of said container which is subject to outward deformation when the internal pressure of said container exceeds a predetermined level, a weakened line of reduced material thickness formed in said wall and adapted to fracture to vent the pressurized fluid from said container in response to the stresses thereon during said outward deformation of said wall, and means for controlling the location in said wall at which said deformation starts when the internal pressure of said container exceeds said predetermined level, wherein said wall is a generally inwardly concave end wall which is joined to one end of a tubular side wall of said container, said end wall having a structural integrity which reacts to an increase in fluid pressure in said container above a predetermined level by initially undergoing at least a partial outward deformation at a location along the outer peripheral area thereof, the outward deformation commencing in said outer peripheral area and progressing inwardly, and wherein said weakened line of reduced material thickness is located in a central portion of said end wall and said means for controlling the location in the end wall at which said deformation starts is located radially outwardly from said weakened line such that said means for controlling is intersected by a radius line of said end wall which passes through said weakened line.

6. A safety vent for an internally pressurized fluid container according to claim 5, wherein said means for controlling the location in said end wall at which said deformation starts includes an elongated rib which extends in a radial direction in said end wall.

7. A safety vent for an internally pressurized fluid container according to claim 5, wherein said weakened line of reduced material thickness is in the form of an arc of a circle about the center of said end wall.

8. A safety vent for an internally pressurized fluid container according to claim 7, wherein said end wall is dome-shaped inwardly concave and wherein said weakened line of reduced material thickness is formed in an annular recess provided in said end wall.

9. A safety vent for an internally pressurized fluid container according to claim 5, wherein said end wall includes a pair of weakened lines of reduced material thickness in the form of arcs located in spaced relationship on opposite sides of a circle about the center of said end wall.

10. A safety vent for an internally pressurized fluid container according to claim 9, wherein said means for controlling the location in said end wall at which said deformation starts includes a pair of elongated ribs which are formed in said end wall radially outwardly from central portions of respective ones of said weakened lines, said elongated ribs extending in radial directions in said end wall.

11. A safety vent for an internally pressurized fluid container according to claim 10, wherein said ribs have a predetermined length to locally weaken the resistance of said end wall to outward deformation so that said end wall is outwardly deformed when the internal pressure exceeds said predetermined level.

12. A safety vent for an internally pressurized fluid container comprising a generally dome-shaped inwardly concave end wall of said container which is subject to outward deformation when the internal pressure of said container exceeds a predetermined level, said outward deformation being initiated at an outer peripheral area of said end wa11, a weakened 1ine of reduced material thickness formed in a central portion of said wall and adapted to fracture to vent the pressurized fluid from said container in response to the stresses thereon during said outward deformation of said wall, and an elongated rib formed in said end wall radially outwardly from said weakened line between the outer peripheral area of said end wall and said weakened line such that said elongated rib is intersected by a radius line of said end wall which passes through said weakened line of reduced material thickness with at least a portion of said rib extending proximate said weakened line of reduced material thickness.

13. A safety vent for an internally pressurized fluid container according to claim 12, wherein said dome-shaped inwardly concave end wall is joined to one end of a tubular side wall of said container.

14. A safety vent for an internally pressurized fluid container according to claim 12, wherein said elongated rib extends in a radial direction in said end wall.

15. A safety vent for an internally pressurized fluid container according to claim 14, wherein said weakened line of reduced material thickness is in the form of an arc of a circle about the center of an end wall.

16. A safety vent for an internally pressurized fluid container according to claim 15, wherein said weakened line of reduced material thickness is formed in an annular recess provided in said end wall.

17. A safety vent for an internally pressurized fluid container according to claim 12, wherein said end wall includes a pair of weakened lines of reduced material thickness in the form of arcs located in spaced relationship on opposite sides of a circle about the center of said end wall.

18. A safety vent for an internally pressurized fluid container according to claim 17 wherein a pair of elongated ribs are formed in said end wall radially outwardly from central portions of respective ones of said weakened lines, said elongated ribs extending in radial directions in said end wall.

19. A safety vent for an internally pressurized fluid container according to claim 18, wherein said ribs have a predetermined length to locally weaken the resistance of said concave end wall to outward deformation so that said end wall is outwardly deformed when the internal pressure of said container exceeds said predetermined level.

20. A container according to claim 12, wherein said rib is an elongate line of relatively harder material in said wall formed by locally heat treating and/or working said material.

* * * * *